US005629969A

United States Patent [19]

Koshishiba

[11] Patent Number: 5,629,969

[45] Date of Patent: May 13, 1997

[54] X-RAY IMAGING SYSTEM

[75] Inventor: Hiroya Koshishiba, Yokohama, Japan

[73] Assignee: Hitachi, Ltd., Tokyo, Japan

[21] Appl. No.: 404,198

[22] Filed: Mar. 13, 1995

[30] Foreign Application Priority Data

Mar. 18, 1994 [JP] Japan ..... 6-048316

[51] Int. Cl.[6] ..... H01J 35/30

[52] U.S. Cl. ..... 378/138; 378/98.6; 378/141

[58] Field of Search ..... 378/98.2, 98.6, 378/138, 141

[56] References Cited

U.S. PATENT DOCUMENTS

| | | | |
|---|---|---|---|
| 2,730,566 | 1/1956 | Bartow et al. | 378/98.6 |
| 3,833,810 | 9/1974 | Efanov et al. | 378/98.6 |
| 5,420,906 | 5/1995 | Smit et al. | 378/141 |

FOREIGN PATENT DOCUMENTS

| | | |
|---|---|---|
| 2-138856 | 5/1990 | Japan . |
| 3-274500 | 12/1991 | Japan . |
| 4-144045 | 5/1992 | Japan . |

*Primary Examiner*—Craig E. Church

*Attorney, Agent, or Firm*—Fay, Sharpe, Beall, Fagan, Minnich & McKee

[57] ABSTRACT

In a micro focus X-ray imaging system using a transmission type target, a transmitted X-ray image is uniformly bright. The micro focus X-ray imaging system is structured so that (i) the fine focussed electron beam 1 is irradiated to a target in which a tungsten film 10 is deposited thinly on a beryllium foil 11, (ii) the tungsten film 10 is cooled by a circular thermoelectric cooling device 14, and (iii) an X-ray image intensifier 22 is installed other than on the prolonged line in a travel direction of the electron beam 1 and the transmitted X-ray image of a sample 7 is detected by the X-ray image intensifier 22 and the CCD camera 24. As a result thereof, in the case of a thin transmission-type target, intensive X-rays are generated in the travel direction of the electron beam and X-ray image intensifier is installed other than on the prolonged line in the travel direction of the electron beam, so that X-rays with a uniform intensity can be irradiated to the X-ray image intensifier and accordingly a transmitted X-ray image which is uniformly bright can be obtained.

10 Claims, 8 Drawing Sheets

X-RAY IMAGING SYSTEM

BACKGROUND OF THE INVENTION

The present invention relates to an X-ray imaging system and more particularly to a micro focus X-ray imaging system using a transmission-type target which is suited to the high resolution X-raying test.

The focal spot size of the X-ray source may be cited as a factor for controlling the detecting resolution in the X-raying test. Therefore, in the X-raying test requiring high resolution, a micro focus X-ray source is used.

Targets used for the micro focus X-ray source are broadly divided into the transmission type which uses X-rays which transmit a target and the reflection type which uses X-rays which are emitted sideways. From a viewpoint of the resolution, the transmission type is superior because the spread of electron beams in a target can be minimized. An X-ray source using a transmission type target is indicated, for example, in Japanese Patent Application Laid-Open 2-138856, Japanese Patent Application Laid-Open 3-274500, and Japanese Patent Application Laid-Open 4-144045. X-rays of a minute focal spot size which are obtained by irradiating a focusing electron beam to a transmission type film target are irradiated to a sample, and an image is picked up by enlarging and projecting the transmitted X-rays geometrically, and the minute internal structure of the sample is observed.

To improve the resolution it is necessary to reduce the spot diameter of a focusing electron beam and make the film thickness of the transmission type target thinner. However, when the film thickness of the transmission type target is made thinner or the acceleration voltage for the focusing electron beam is increased, the intensity of X-rays generated is oriented and a bright spot is generated at the center of the transmitted X-ray image. As a result, the image quality is extremely lowered.

When the spot diameter of a focussed electron beam is reduced, the current density of a focussed electron beam which is irradiated to the target is increased and the target damage is increased.

SUMMARY OF THE INVENTION

An object of the present invention is to provide an X-ray imaging system using a transmissionstype target which will not generate a bright spot on an image.

Another object of the present invention is to provide an X-ray imaging system using a transmission-type target which has a long life time.

The above first object is accomplished by using a means for generating and accelerating an electron beam, a means for focusing the electron beam, a transmission-type target for generating X-rays, and an X-ray detection means for detecting X-rays which transmit through a sample, wherein the X-ray detection means is not installed on the prolonged line in the travel direction of a focussed electron beam which is irradiated to the transmission-type target.

The above second object is accomplished by using a means for generating and accelerating an electron beam, a means for focusing the electron beam, a transmission-type target for generating X-rays, a means for cooling the transmission-type target, and an X-ray detection means for detecting X-rays which transmit through a sample.

To realize a micro focus X-ray source, it is not sufficient only to limit an electron beam which is irradiated to a transmission-type target. The reason is that the electrons irradiated to the target are scattered and enter inside the target. For example, it is said that the scattering region of an electron beam at an acceleration voltage of 100 kV is more than 5 μm. Therefore, it is necessary to make the target film thinner limit the scattering region of an electron beam, and make the focal spot size smaller.

When a transmission type target film is made thinner, the intensity of X-rays generated is oriented. As shown in FIGS. 1A and 1B, the intensity of X-rays which are generated in the travel direction of focusing an electron beam which is irradiated to a transmission-type target is strong. Measurement examples of the intensity distribution of X-rays which are generated from a tungsten target with a film thickness of 1 μm are shown in FIGS. 2 and 3. FIG. 2 shows data when the acceleration voltage of a focusing electron beam is 75 kV and FIG. 3 shows data when the acceleration voltage is 200 kV. When the acceleration voltage becomes high, the intensity peak of X-rays increases suddenly. The area of strong X-rays is about 0.7° and the intensity of X-rays in the other area is constant.

DESCRIPTION OF THE PREFERRED EMBODIMENTS

Figure 1A:
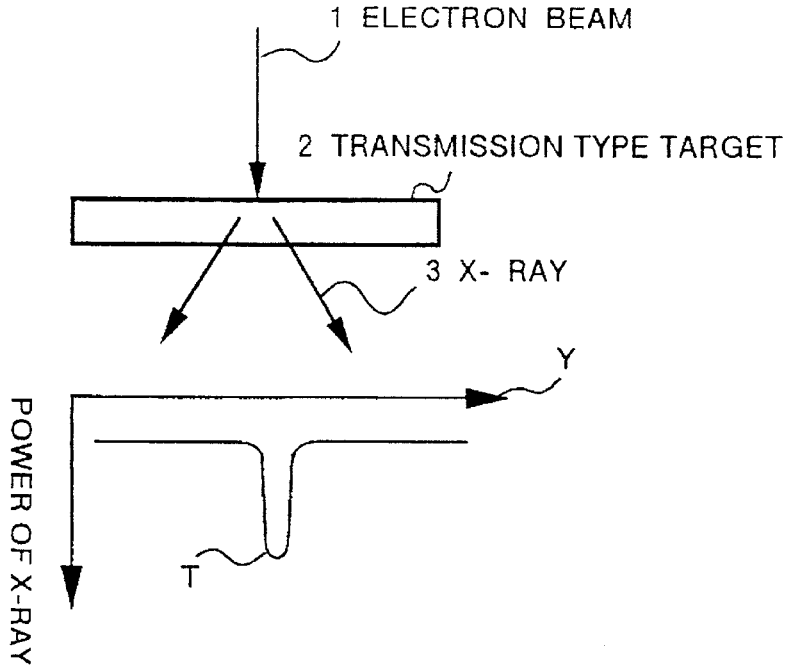
FIGS. 1A and 1B are Schematic views showing the intensity distribution of X-rays generated from a transmission-type target.
Figure 1B:
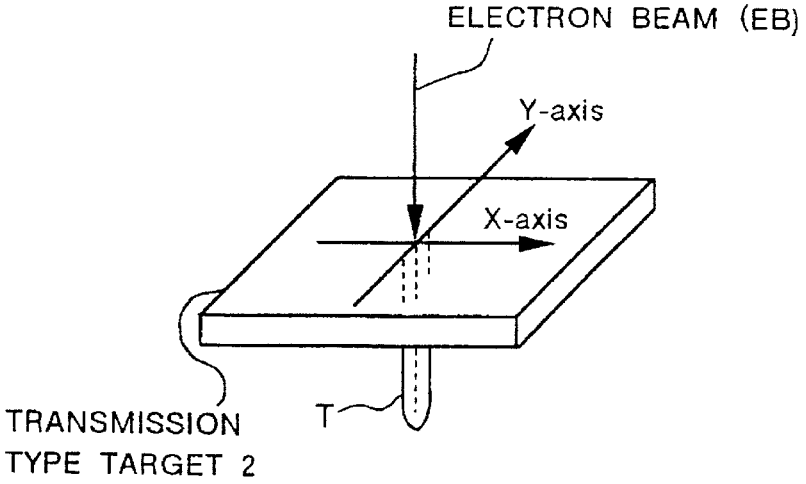
Figure 2:
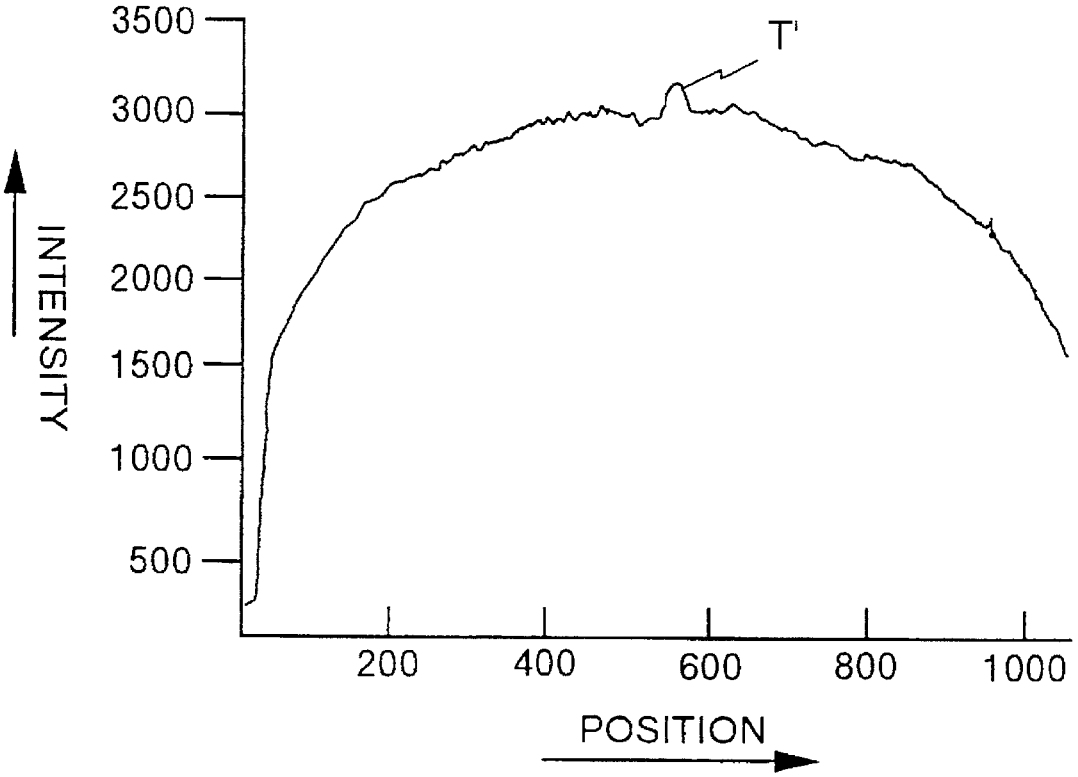
FIG. 2 is a drawing showing the intensity distribution of X-rays generated from a transmission-type target which is obtained by an experiment.
Figure 3:
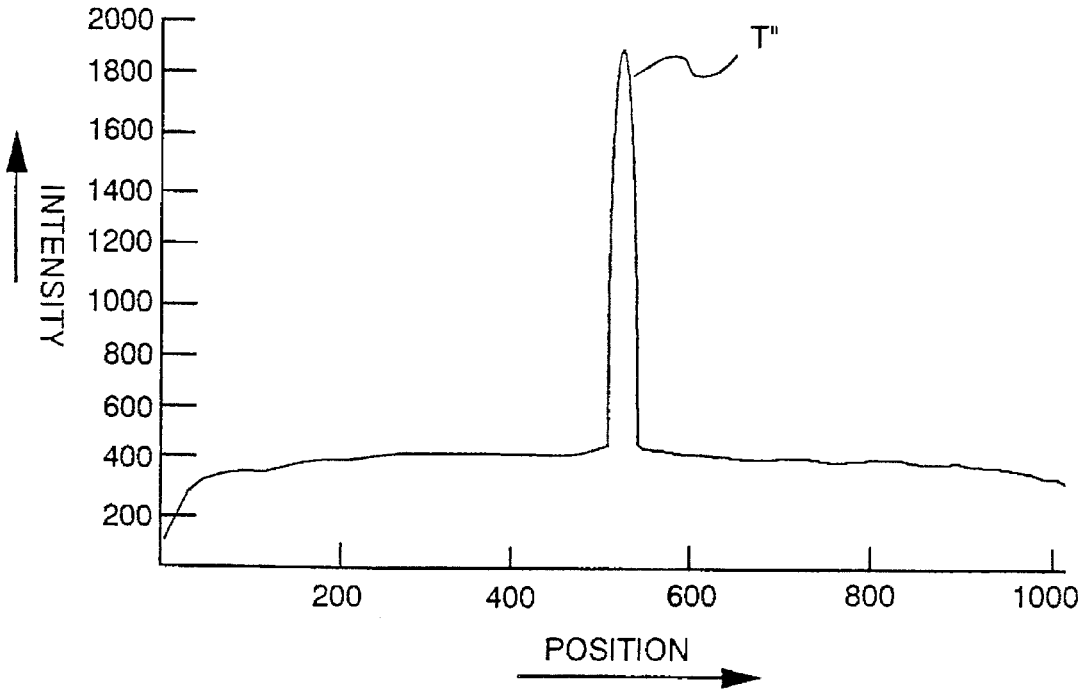
FIG. 3 is a drawing showing the intensity distribution of X-rays generated from a transmission-type target which is obtained by an experiment.

In an X-ray imaging system using a conventional transmission-type target, an electron gun, a transmission-type target, a sample, and an X-ray image detector are installed in a line, so that the X-ray image detector is installed in the travel direction of a focussed electron beam which is irradiated to the transmission-type target. As a result, the peak of X-ray intensity distribution is positioned at the center of the X-ray image detector. According to the present invention, the line connecting the electron gun and transmission-type target does not coincide with the line connecting the transmission-type target, sample, and X-ray image detector and they are inclined to each other. Therefore, the X-ray image detector is not installed in the travel direction of a focussed electron beam which is irradiated to the transmission-type target but in the oblique direction. As a result, the intensity of X-rays which are irradiated to the X-ray image detector becomes uniform.

It is said that the rate of the electron energy irradiated to a target which is converted to X-rays is at most 1% and the remaining 99% is converted to heat. As a result, the target becomes extremely high in temperature and is damaged seriously. Therefore, a reflection-type target is rotated or cooled with water. A transmission-type target uses two films so as to radiate heat but not be cooled. The reason is that to shorten the distance between the transmission-type target and a sample (working distance, WD), there is no space where a target cooling structure is installed. In the case of a transmission-type target, to detect an X-ray image which transmits through a sample after it is geometrically enlarged and projected so as to utilize the minute focal spot size and to obtain a high magnification factor, it is necessary to shorten the WD.

According to the present invention, a cylindrical cooling device is installed on the irradiation side of a focussed electron beam of the transmission-type target so as to cool the transmission-type target. Since the cooling device is cylindrical, the electron beam passes through the hollow and is irradiated to the target. The cooling device is installed on the side of the electron beam irradiation surface, so that a sample can be brought extremely close to the X-ray emission surface.

By doing this, a high resolution X-ray imaging system can be realized. A typical constitution of a high resolution X-ray imaging system is an electron gun, electron lens, cooling device, transmission-type target, sample stage, X-ray TV imaging system, and TV monitoring device. An electron beam generated by the electron gun is focused thinly by the electron lens and irradiated to the transmission-type target. In this case, the target is cooled by the cooling device. When the diameter of the electron beam is made thinner sufficiently and the thin film for generating X-rays is made thinner sufficiently, a minute focal spot size is obtained, so that a transmitted image of a clear sample without half shadow fading can be obtained. The transmitted X-ray image of the sample is detected by the X-ray TV imaging system which is installed in the oblique direction and displayed on the TV monitoring device. The sample is held on the sample stage and when the stage is moved, the part to be transmitted is changed.

Figure 4:
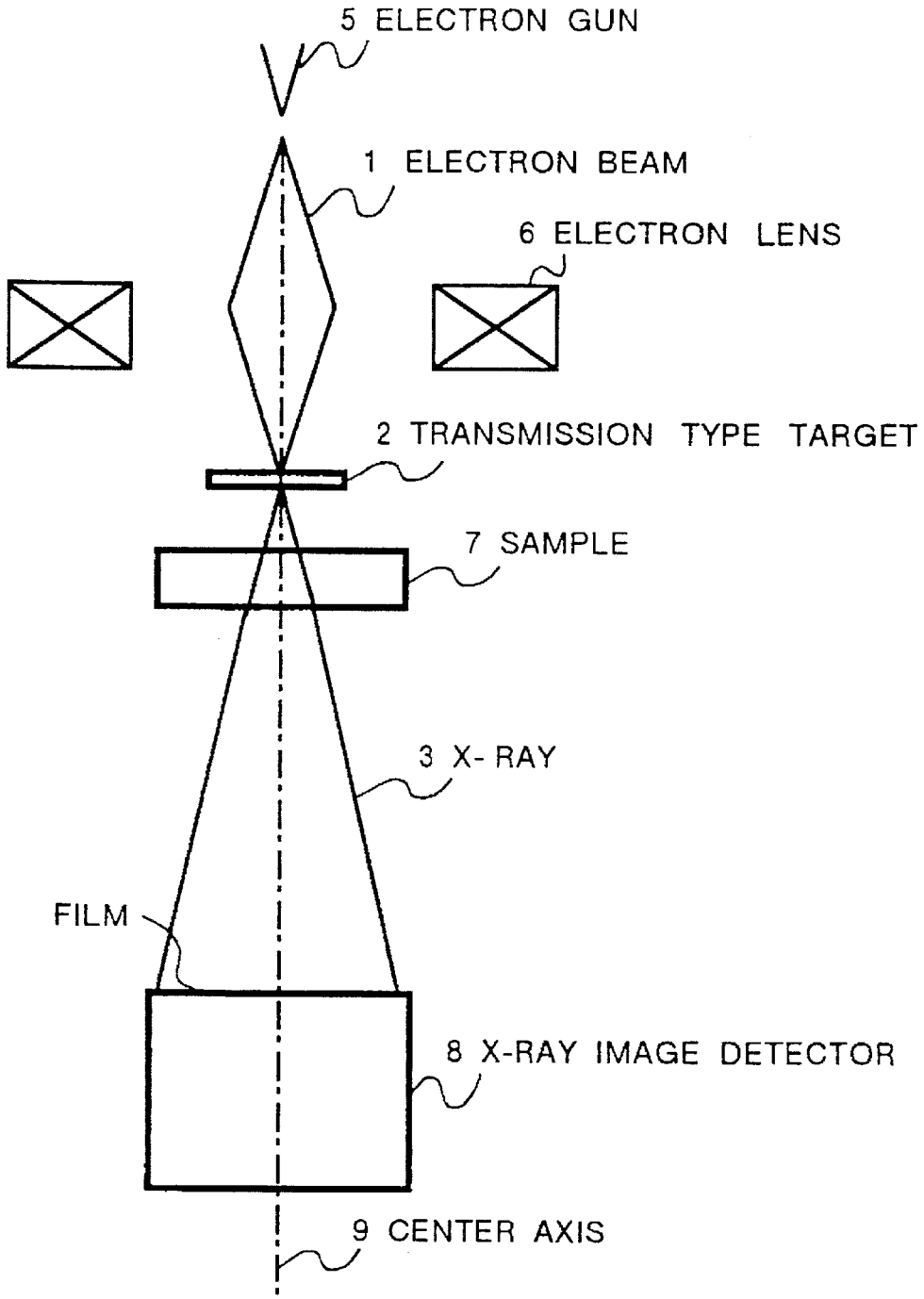
FIG. 4 PRIOR ART
FIG. 4 is a drawing showing the constitution of an X-ray imaging system using a conventional transmission-type target.
Figure 5:
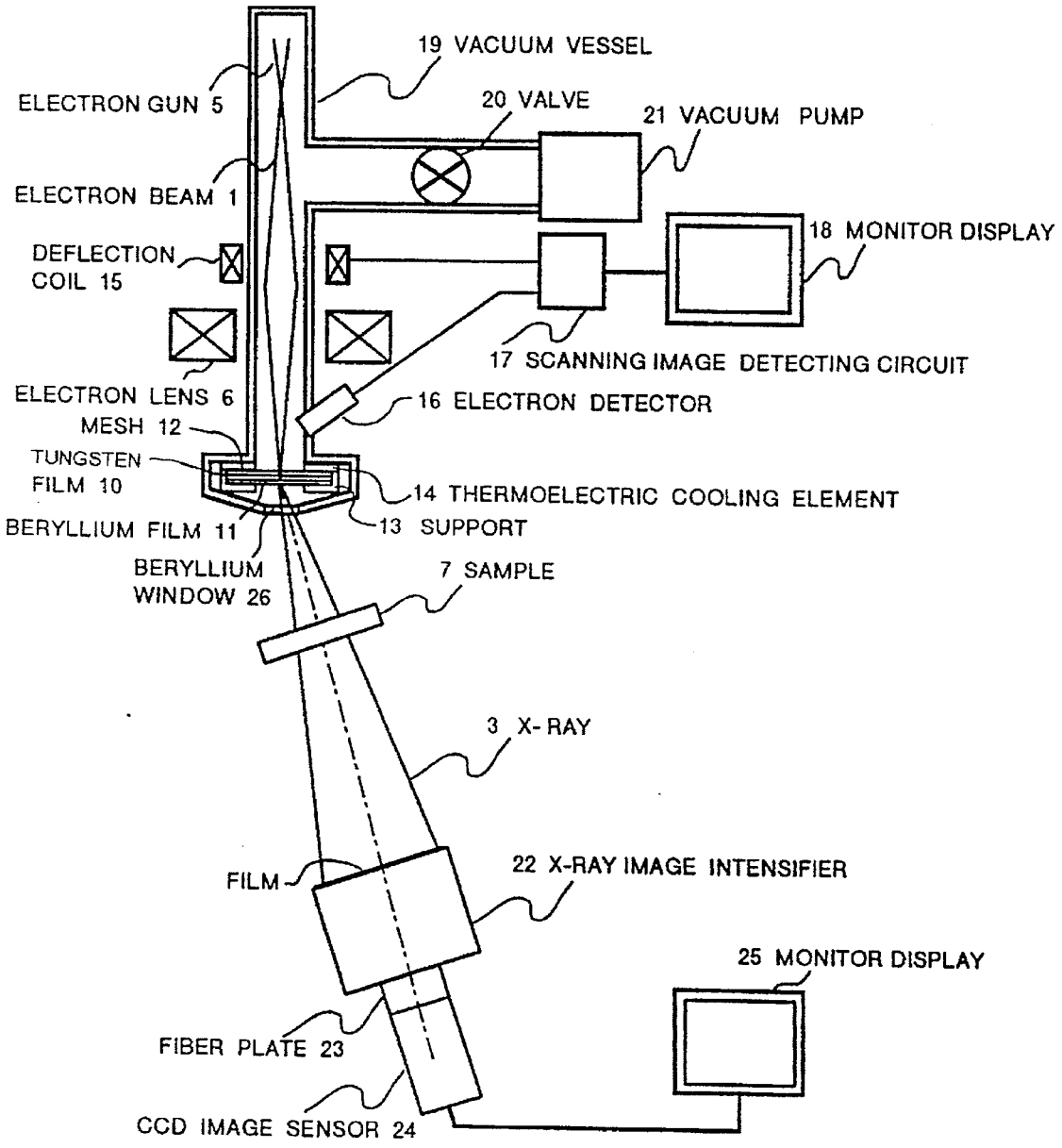
FIG. 5 is a drawing showing the first embodiment of an X-ray imaging system using a transmission-type target.

Firstly, the constitution of an X-ray imaging system using a conventional transmission-type target is shown in FIG. 4. When an electron beam 1 which is generated by an electron gun 5 is focused by an electron lens 6 and irradiated to a transmission-type target 2, X-rays 3 are generated. The X-rays which transmit through a sample 7 are enlarged and projected and detected by an X-ray image detector 8. In this case, the electron gun 5, the transmission-type target 2, the sample 7, and the X-ray image detector 8 are lined up on a center axis 9. When the film thickness of the transmission-type target 2 is made thinner, the intensity of X-rays which are generated in the direction of the center axis is increased and the center is detected bright by the X-ray image detector The first embodiment of the X-ray imaging system of the present invention is shown in FIG. 5. An electron beam 1 generated by an electron gun 5 is focused by an electron lens 6 and irradiated to a transmission-type target. The transmission-type target is a two-layer film consisting of a tungsten film 10 for generating X-rays and a beryllium film 11 for holding the tungsten film and a mesh 12 is closely adhered onto the tungsten film 10. This transmission-type target is closely adhered to a thermoelectric cooling device 14 by a support 13. The electron beam 1 scans on the tungsten film 10 by a deflection coil 15 and reflected electrons generated by it or secondary electrons are detected by an electron detector 16. A scanning image detecting circuit 17 drives the deflection coil 15, receives a signal from the electron detector 16, and displays a formed scanning electron image on a monitor display 18. The path of the electron beam 1 is sealed hermetically by a vacuum vessel 19, which is kept vacuum by a vacuum pump 21 via a valve 20. A part of the vacuum vessel 19 is a beryllium window 26 for taking out X-rays 3. An X-ray image which transmits through a sample 7 is converted to an optical image by an X-ray image intensifier 22 and the detected image is displayed on a monitor display 25.

The operation of the first embodiment will be shown below. The electron gun 5 generates electrons and accelerates them to the predetermined; tube voltage. It is desirable to use bright lanthanum hexaboride ($LAB_6$) as a filament for generating electrons. However, general tungsten (W) may be used. The electron lens 6 functions so as to focus an 10 electron beam to the desired X-ray focal spot size or less. To obtain a high resolution, a minute focal spot size is essential and for example, an electron beam is focused to about 1 μm.

One electromagnetic lens is shown in FIG. 5. However, it is desirable to use a plurality of electromagnetic lenses to limit an electron beam thinly and it may be considered to use a field lens. The transmission-type target is a two layer film in which the tungsten film 10 is deposited on the beryllium film 11 by sputtering or CVD. The film thickness of the beryllium film 11 is within the range from 10 to several hundreds μm and the film thickness of the tungsten film 10 is the desired X-ray focal spot size or less, for example, from 1 to 4 μm. To ascertain that the focussed electron beam 1 is surely limited on the surface of the tungsten film 10, a scanning electron image on the surface of the transmission-type target is detected. The exciting current of the electron lens is adjusted so that the surface of the transmission-type target can be seen most clearly and the electron beam is focused. Since the surface of the tungsten film 10 is smooth, it is desirable to adhere the mesh onto it and focus the electron beam by detecting a mesh pattern. A copper 1000-mesh or 2000-mesh can be easily obtained and is convenient.

After the electron beam is focused, the scanning is stopped, and the electron beam is irradiated to one point on the tungsten film 10, and the X-ray source is fixed. When the point to be irradiated is changed everyday, the damage of the tungsten film 10 can be reduced and there is no need to replace the tungsten film for a long period of time. To cool the transmission-type target which becomes warm due to heat generated by irradiation of the electron beam, the transmission-type target is closely adhered to the thermoelectric cooling device 14. The thermoelectric cooling device 14 functions as a heat pump for transferring heat of the transmission-type target to the vacuum vessel 19. Since the transmission-type target is mounted in a vacuum, there is no need to worry about dew and frost even when it is cooled under the room temperature and it can be cooled under 0° C. Since the transmission-type target is in a vacuum, both the heat insulation and cooling efficiency are satisfactory. Water cooling by a circular pipe without the thermoelectric cooling device 14 being used can obtain good results.

The generated X-rays are taken out outside via the beryllium window 26. Since the X-rays have an intensity peak in the travel direction of the electron beam, the X-ray image detector is installed in the oblique direction instead of on the prolonged line in the travel direction of the electron beam. By doing this, X-rays with an even intensity are irradiated to the X-ray image detector. Since it is necessary to install the sample 7 also in the oblique direction, it is desirable that the periphery of the X-ray taking-out port of the vacuum vessel 19 is conical. The X-ray image detector consists of an X-ray image intensifier and a video camera. A transmitted X-ray image of the sample 7 is converted to a visible-rays image by the X-ray image intensifier 22, transmitted to a fiber plate 23, and detected by a CCD image sensor 24. Needless to say, an imaging tube may be used as a video camera instead of the CCD image sensor. Since there are many noises generally in a transmitted X-ray image, a detected image is often added to it. When a many-hour exposure type CCD image sensor is used, an image can be added on the sensor, so that it is favorable. The X-ray image intensifier 22 and the CCD image sensor 24 may be coupled by a lens instead of the fiber plate.

Figure 6:
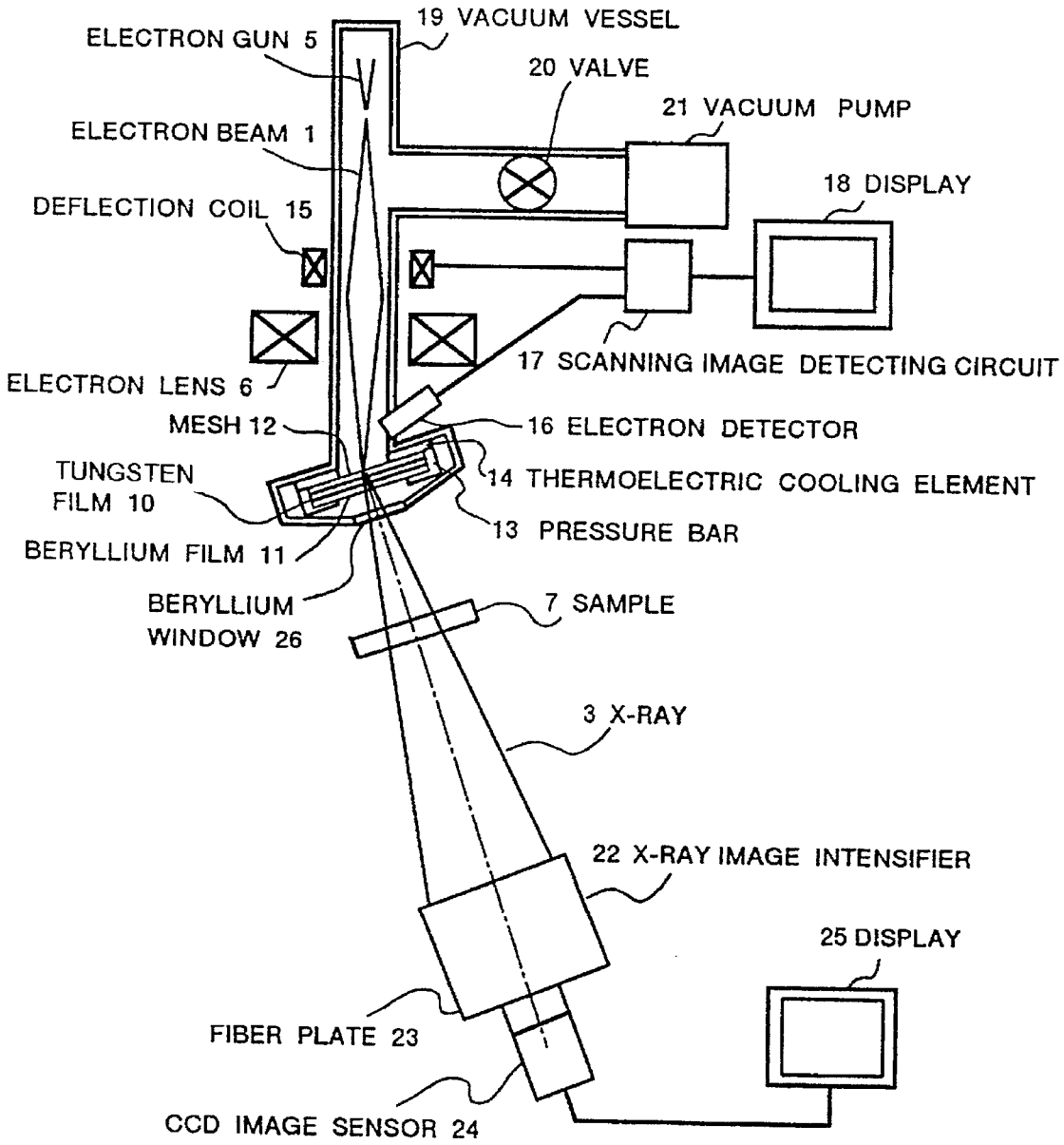
FIG. 6 is a drawing showing the second embodiment of an X-ray imaging-system using a transmission-type target.

The second embodiment of the X-ray imaging system of the present invention is shown in FIG. 6. An electron beam 1 generated by an electron gun 5 is focused by an electron lens 6 and irradiated to a transmission-type target. The transmission-type target is a two-layer film consisting of a tungsten film 10 for generating X-rays and a beryllium film 11 for holding the tungsten film and a mesh 12 is closely adhered onto the tungsten film 10. This transmissiontype target is closely adhered to a thermoelectric cooling device 14 by a support 13. The electron beam 1 scans on the tungsten film 10 by a deflection coil 15 and reflected electrons generated by it or secondary electrons are detected by an electron detector 16.

A scanning image detecting circuit 17 drives the deflection coil 15, receives a signal from the electron detector 16, and displays a formed scanning electron image on a monitor display 18. The path of the electron beam 1 is sealed hermetically by a vacuum vessel 19, which is kept vacuum by a vacuum pump 21 via a valve 20. A part of the vacuum vessel 19 is a beryllium window 26 for taking out X-rays 3. An X-ray image which transmits through a sample 7 is converted to an optical image by an X-ray image intensifier 22 and the detected image is displayed on a monitor display 25. As mentioned above, the basic constitution is the same as that of the first embodiment. A difference from the first embodiment is the mounting direction of the transmission-type target. In the first embodiment, the transmission-type target is mounted perpendicularly to the axis of the electron irradiation system and an electron beam is irradiated perpendicularly to the transmission-type target. In the second-embodiment, the transmission-type target is mounted in the oblique direction and an electron beam is irradiated in the oblique direction. When the transmission-type target, sample, and X-ray image detector are installed in parallel with each other, the interval (WD) between the transmission-type target and a sample can be reduced easily and a high magnification factor can be obtained.

Figure 7:
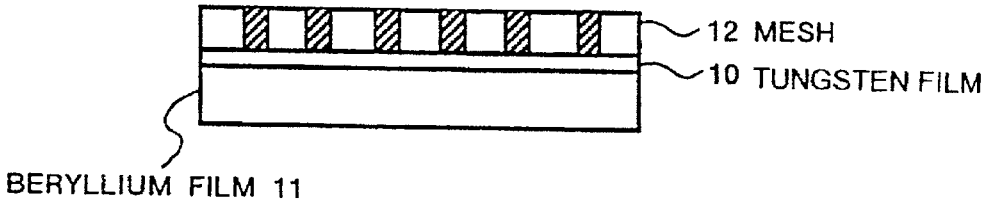
FIG. 7 is a drawing showing the first embodiment of a transmission-type target.

The first embodiment of a transmission-type target which is used in the X-ray imaging system is shown in FIG. 7. The transmission-type target is a two-layer film in which a tungsten film 10 which is an X-ray generation film is deposited on a beryllium film 11 which is a holding layer by sputtering or CVD. X-rays are generated by the tungsten film 10 which is a heavy metal but little on the beryllium film 11 which is a light metal. The beryllium film 11 has a function for increasing the mechanical strength and a function for radiating heat generated by the tungsten film 10. The film thickness of the beryllium film 11 is within the range from 10 to several hundreds um and the film thickness of the tungsten film 10 is the desired X-ray focal spot size or less, for example, from 1 to 4 um. As an X-ray generation layer, a heavy metal other than tungsten, for example, molybdenum may be used. As a holding layer, a light metal other than beryllium, for example, carbon may be used. A mesh is closely adhered to the tungsten film 10 so as to facilitate detection of a scanning image. A copper 1000-mesh or 2000-mesh is used.

Figure 8:
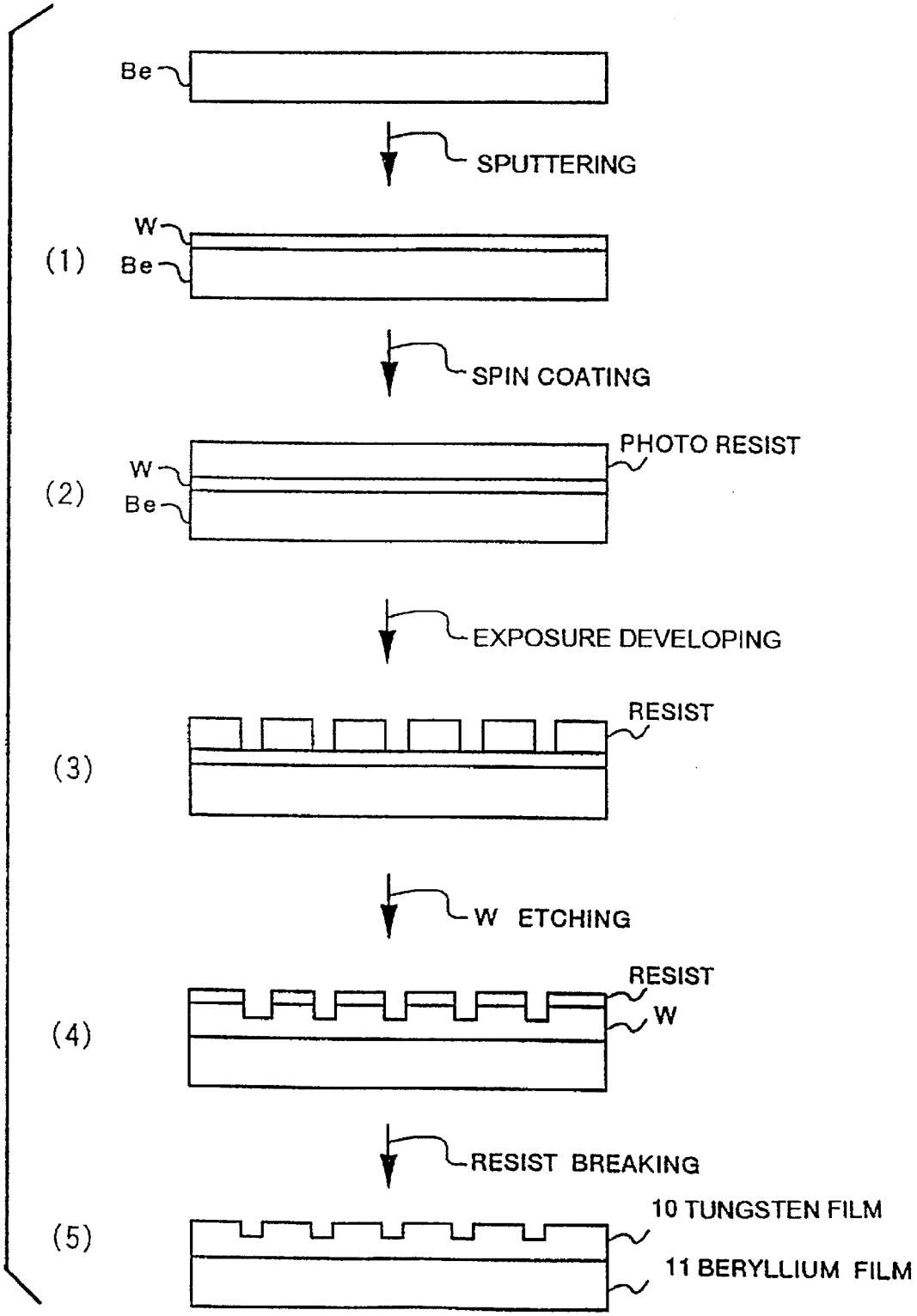
FIG. 8 is a drawing showing the second embodiment of a transmission-type target.

The second embodiment of a transmission-type target which is used in the X-ray imaging system is shown in FIG. 8. The transmission-type target is a two-layer film in which a tungsten film 10 is deposited on a beryllium film 11 by sputtering or CVD. Grooves are cut on the tungsten film 10 so as to facilitate detection of a scanning image. The grooves are processed by a focussed ion beam or in the lithographic process.

Figure 9:
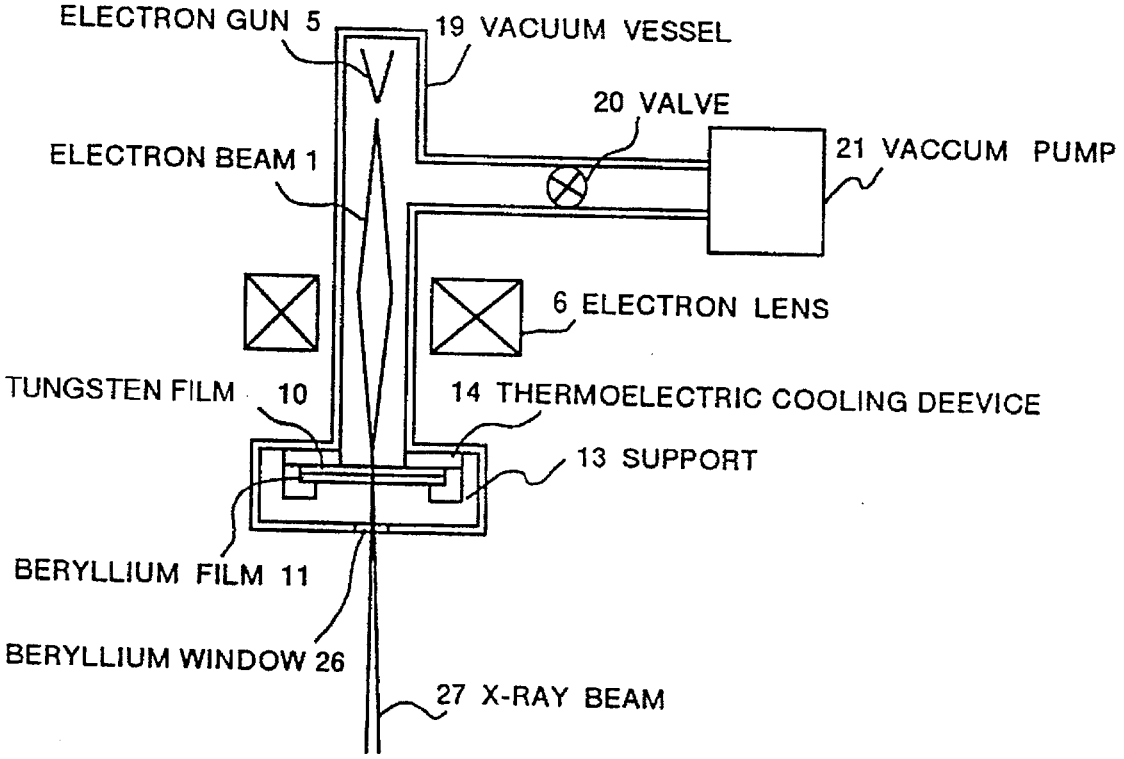
FIG. 9 is a drawing showing an embodiment of an X-ray beam generator.

An embodiment of an X-ray beam generator which uses a transmission-type target is shown in FIG. 9. An electron beam 1 generated by an electron gun 5 is focused by an electron lens 6 and irradiated to a transmission-type target. The transmission-type target is a two-layer film consisting of a tungsten film 10 for generating X-rays and a beryllium film 11 for holding the tungsten film. This transmission-type target is closely adhered to a thermoelectric cooling device 14 by a support 13. The path of the electron beam 1 is sealed hermetically by a vacuum vessel 19, which is kept vacuum by a vacuum pump 21 via a valve 20. A part of the vacuum vessel 19 is a beryllium window 22 for taking out X-rays 3. When the tungsten film 10 is made thinner, highly oriented X-rays having a peak in the travel direction of the electron beam 1 are generated. When an X-ray taking-out window 22 is installed on the prolonged line in the travel direction of the electron beam, an X-ray beam is obtained.

As clear from the above explanation, the present invention obtains good results indicated below. Namely, since the X-ray generating layer is a thin film and the transmission-type target has a two-layer structure consisting of the X-ray generating layer and a holding layer, the electron scattering region is limited and a micro focus X-ray source is obtained.

Since a thin transmission-type target is used, an X-ray beam can be generated in the travel direction of an electron beam.

Since the X-ray image detector is not installed on the prolonged line in the travel direction of the electron beam, transmitted X-ray images having an even intensity can be detected.

Since the transmission-type target is cooled by a circular cooling device, the life time of the target is lengthened, and an electron beam with a large current can be irradiated, and the X-ray dose generated is increased. Furthermore, since the circularly cooling device is installed on the electron irradiation side, the interval between the transmission-type target and sample can be shortened and a high magnification factor is obtained.

Since a function for deflecting the electron beam is provided and a scanning electron image of the X-ray generating layer is detected, the focus of the electron beam can be surely adjusted to the X-ray generating layer. Particularly when a mesh is put on the X-ray generating layer, the electron beam can be focused easily.

When the function for deflecting the electron beam is provided and the electron beam irradiation position is shifted when the target is degraded, the life time of the target will be lengthened.

When a fine electron beam is irradiated to a transmission type target having a two-layer structure consisting of a thin X-ray generating layer and a supporting film so as to generate a micro focus X-ray source and a sample and an X-ray image detector (an X-ray image intensifier and a manyhour exposure time CCD camera) are installed obliquely to the optical axis of an electron optical system, an X-ray imaging system having a high resolution is obtained.

What is claimed is:

1. An X-ray imaging system comprising:

an electron gun for generating and accelerating an electron beam;

an electron optical means for focusing the electron beam generated from the electron gun and irradiating said electron beam to a transmission-type target, said transmission-type target being disposed on a prolonged line in an incident direction of the focussed electron beam directed to said transmission-type target;

a scanning electron image detection unit for deflecting said electron beam and detecting reflected electrons from the transmission-type target and secondary electrons;

an X-ray image intensifier installed other than on the prolonged line in the incident direction of the electron beam directed to said transmission-type target, said X-ray image intensifier being an image detector for detecting transmitted X-rays; and a device for imaging an output image of said X-ray image intensifier.

2. The X-ray imaging system according to claim 1, further comprising a circular cooling device for cooling said transmission-type target.

3. An X-ray imaging system comprising:

an electron gun for generating and accelerating an electron beam;

an electron optical means for focusing the electron beam generated from the electron gun and irradiating it to a transmission-type target;

a scanning electron image detection unit for deflecting said electron beam and detecting reflected electrons from the transmission-type target and secondary electrons;

a transmission-type target having a two-layer structure composed of a thin X-ray generating layer and a supporting layer;

a circular cooling device for cooling the transmission-type target, an X-ray image intensifier which is installed other than on the prolonged line in the incident direction of the electron beam to the transmission-type target; and, a device for imaging an output image of the X-ray image intensifier.

4. The X-ray imaging system according to claim 3, wherein said transmission-type target further comprises a focussed mesh closely adhered to the thin X-ray generating layer.

5. The X-ray imaging system according to claim 3, wherein said transmission-type target further comprises focusing grooves in the thin X-ray generating layer.

6. The X-ray imaging system according to claim 3, wherein the thin X-ray generating layer is tungsten.

7. The X-ray imaging system according to claim 3, wherein the supporting layer is beryllium.

8. The X-ray imaging system according to claim 3, wherein the film thickness of the thin X-ray generating layer is within a range from 1 to 4 μm.

9. The X-ray imaging system according to claim 3, wherein the film thickness of the supporting layer is within a range from 10 to 900 μm.

10. The X-ray imaging system according to claim 3, wherein the device for imaqing an output image of the X-ray. image intensifier is a many-hour exposure type CCD camera.

* * * * *